United States Patent [19]

Matthew et al.

[11] 4,108,430

[45] Aug. 22, 1978

[54] ACTION GAME

[75] Inventors: Morton P. Matthew, Litchfield, Conn.; Michael I. Rackman, 1710 Glenwood Rd., Brooklyn, N.Y. 11320

[73] Assignee: Michael I. Rackman, New York, N.Y.

[21] Appl. No.: 817,199

[22] Filed: Jul. 20, 1977

[51] Int. Cl.[2] ..... A63F 9/00

[52] U.S. Cl. ..... 273/1 R

[58] Field of Search ..... 273/1 R, 1 E, 1 M; 272/3 R, 3 A, 3 B

[56] References Cited

U.S. PATENT DOCUMENTS 3,540,725 11/1970 Hill ..... 273/1 R 3,731,924 5/1973 Backman et al. ..... 273/1 E

*Primary Examiner*—Paul E. Shapiro

*Attorney, Agent, or Firm*—Gottlieb, Rackman & Reisman

[57] ABSTRACT

An improved action game. Each player can see the other player's piece only when it is in the play area; he is given an indication of the position of his own piece at all times. A player scores a point if his piece catches the other player's piece in the play area. The pieces automatically change shape depending on whether a player is the first or second to enter the play area, and automatic scoring counters are also provided. Each player piece is moved under manual control, a variable number of positions by a ratchet gear drive. The players alternate in moving their pieces.

17 Claims, 15 Drawing Figures

ACTION GAME

This invention relates to action games, and more particularly to action games of the type disclosed in our U.S. Pat. No. 3,731,924, issued on May 8, 1973.

In that game, each player has a piece which moves around a respective circle at a speed controlled by the player. The two circles do not intersect, and a "play area" or region is provided where the circles are nearest each other. Each piece moves around a circle, but goes through the play area only during part of each rotation. While each player's piece is outside of the play area, it is not visible to the other player; however, its position is known by the player himself. Thus each player knows where his piece is at all times, but knows where the other player's piece is only when it is in the play area.

A point is scored whenever a player's piece "catches" the other player's piece in the play area. The first player whose piece enters the play area is a potential loser of a point. If he gets his piece out of the play area before the other player's piece gets into the play area, no point is scored. But if the other player's piece enters the play area before the first player's piece gets out of it, the other player scores a point.

Each player must out-guess the other player and try to trail him as the two of them approach the play area. A player who is clearly ahead of the other player (that is, his piece left the play area before the other player's piece left the play area) can move his piece very fast all the way around, go through the play area, and end up trailing the other player before the other player reaches the play area. Of course, if the other player correctly guesses that the first player is moving his piece at a fast speed, he will similarly move his piece at a fast speed while continuing to trail the first player, enter the play area after him, and score a point.

Each player's piece is either a potential loser (the first one to enter the play area) or a winner (the second one to enter the play area). In order to facilitate the following of the action by the two players, each player's piece can assume one of two images — a cop or a robber. Each of the two images for the piece is preferably colored differently (for example, green for the robber and red for the policeman). A mechanism is provided such that whichever piece enters the play area first, it automatically enters as a robber. The second piece to enter the play area (that is, if he catches the first player's robber already in the play area) automatically enters the play area as a cop. This immediately informs the two players as to which of them scored a point. Furthermore, counting dials are also provided which are incremented automatically each time a point is scored. The first player to score a predetermined number of points is the winner.

In our earlier game, the two player pieces moved continuously under control of a single motor. The motor was coupled to each of the player pieces through a variable speed mechanism, and each player could vary the speed of his piece between minimum and maximum speeds. For neither player to have an advantage over the other, it is important that the two minimum speeds be equal and that the two maximum speeds be equal. The player with the greater maximum speed would have the advantage of his piece being able to catch up to the other player's piece. Similarly, and more important, a player whose piece moves at a smaller minimum speed could simply slow down his piece, insure that the other player's piece enters the play area first, and then overtake it. It is difficult to achieve equal minimum and maximum speeds when cheap mechanical arrangements are employed.

It is a general object of our invention to provide an action game similar to our earlier game but which does not require the use of a motor, thereby decreasing the manufacturing cost of the game, and which insures that neither player has a speed advantage over the other.

Briefly, in accordance with the principles of our present invention, each player has a lever which he moves when it is his turn, the players alternately moving their levers. The path of each player piece is divided into sixteen positions and, depending on how the lever is manipulated, a player can advance his piece one or three positions during each turn. By providing a purely mechanical arrangement, the overall manufacturing cost is reduced. And because the player pieces are advanced in discrete steps, the effective minimum speeds and maximum speeds of the two player pieces are equal.

Further objects, features and advantages of our invention will become apparent upon consideration of the following detailed description in conjunction with the drawing, in which.

Figure 3:
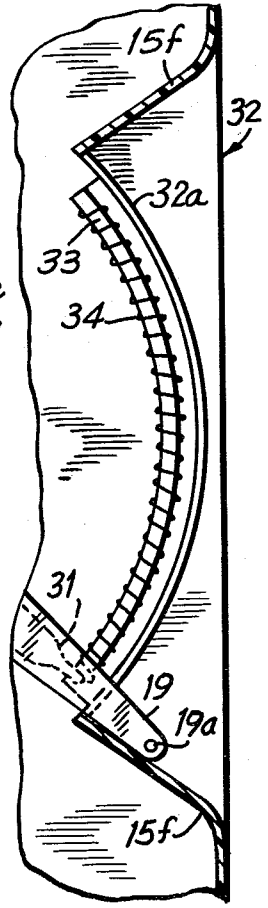
FIG. 3 is a sectional view through the line 3—3 of FIG. 2.
Figure 2:
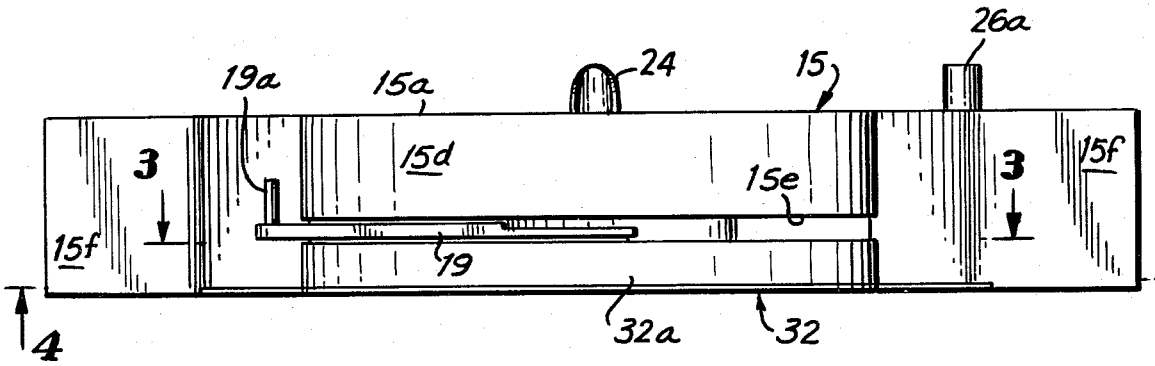
FIG. 2 is a side view of the game of FIG. 1 taken along the line 2—2 of FIG. 1.

The game housing includes a top section 15 and a base 32. The base is flat, as shown in FIGS. 2 and 3, except for an upstanding curved section **32*a* at each end. The top portion of the housing includes a flat upper surface 15*a*, depending walls 15*f*, and two curved walls 15*d* which do not extend all the way down to the base but rather terminate at an edge 15*e* as shown in FIG. 2. When the top part of the housing 15 is placed on the base 32, at each end of the game a slot is formed by wall 32*a* and edge 15*e*. A lever 19 or 20** extends through a slot at each end of the game, it being these two levers which are moved by the players to advance the player pieces.

Figure 4:
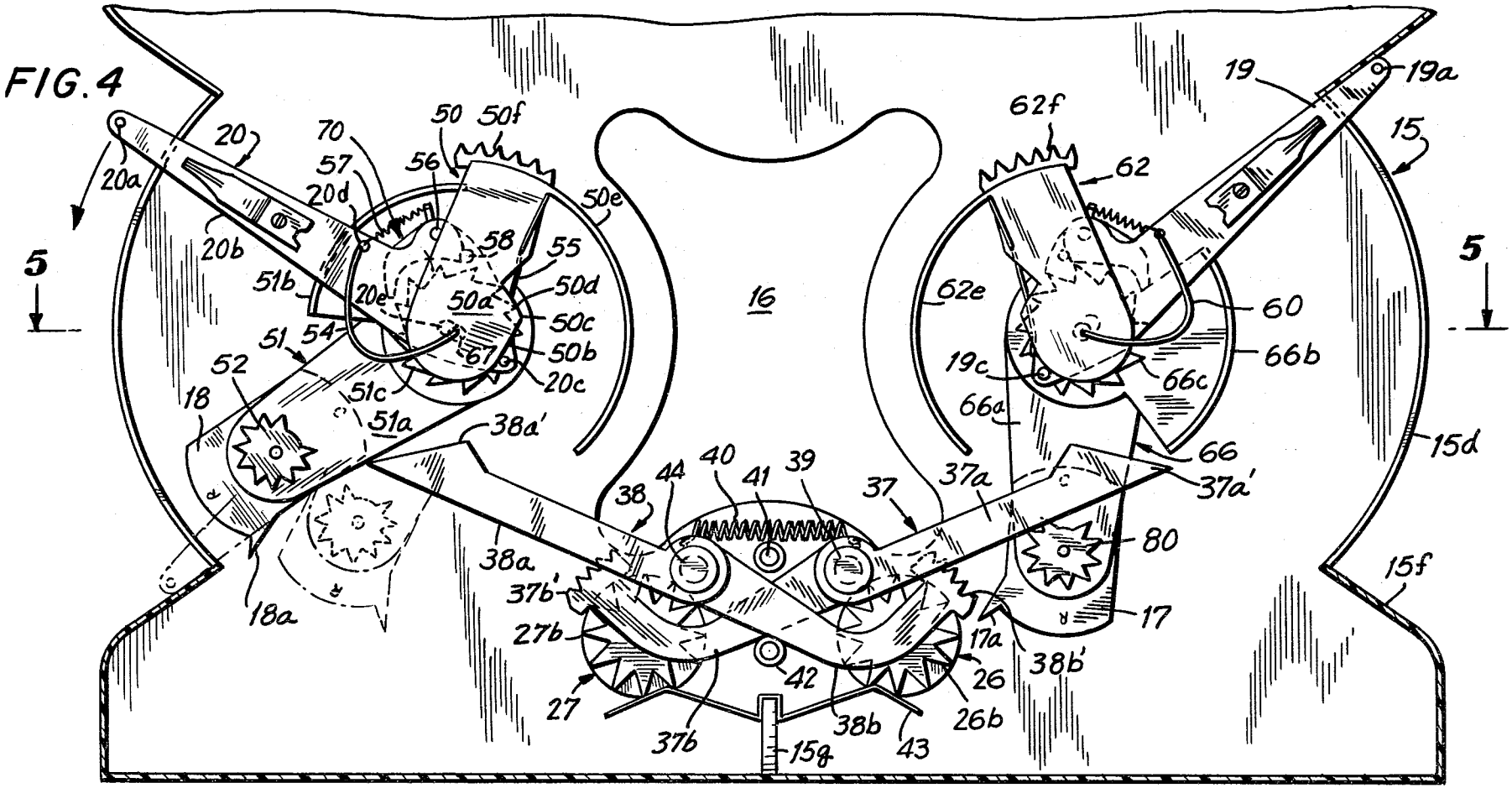
FIG. 4 is a view of the game looking upward with the base section removed.

All of the operative elements for the game are secured to the underside of top cover 15. The only exception is a ridge 33 (FIG. 3) provided at each end of the base, each ridge having a wire 34 wound around it. As will be described below, when one of the levers 19 or 20 is moved by a player, it is moved all the way from its starting position to as far as it can go. Whether the respective player piece moves one position or three positions depends upon whether the lever is pushed in or pulled out at the same time that it is rotated. In order that each player not hear any "clicks" as the other player's piece is moved and thus be able to determine whether a move of one position or three positions has been taken, a "noisemaker" is provided for making noise when each lever is moved. Referring to FIGS. 3 and 4, at the bottom of lever 19 there is a metal tab. As lever 19 is moved, tab 31 bears against wire form 33 and the resulting scraping noise completely obscures any clicks which the other player might hear so that he cannot discern the extent of the move taken by the player whose turn it is. A similar noisemaker arrangement is provided at each end of the game for the respective players.

Figure 1:
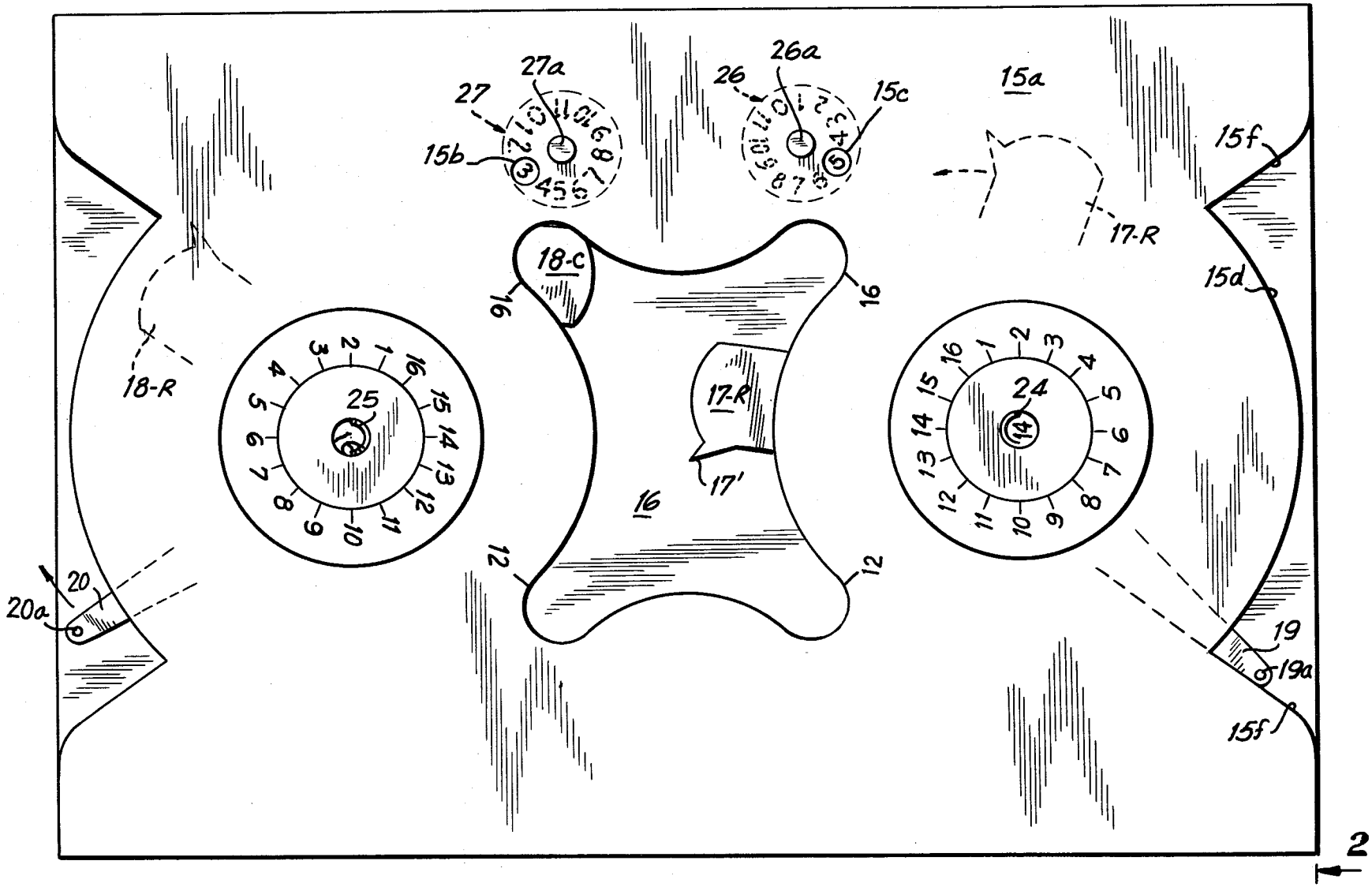
FIG. 1 is a top view of the illustrative embodiment of the invention.

What the players see at the top of the game is shown most clearly in FIG. 1. A cut-out 16 comprises the play area. Each of the player pieces moves in a circle which is divided into sixteen positions; the player piece is visible within the play area only when it is at one of the positions 12-16. The player on the left of FIG. 1 has a player piece bearing the numeral 18 which moves in the clockwise direction. The numbers 1-16 are marked around a circle to permanently identify the sixteen positions on the housing itself. Within the circularly arranged numbers there is a small hole in the cover with an upstanding shield 25 (see FIG. 5) obscuring the hole from the player on the right side of the game. Player piece 18, as will be described below, is secured to a rotating element 51 (FIG. 5) and around the periphery of the upper surface of this element there are marked the numbers 1-16. As the player piece is rotated, the number which appears within shield 25 is the number of the position at which the player piece is located; in FIG. 1 player piece 18 is shown entering position 16, and thus the number 16 is moving into view. In this way the left player always knows the position of his piece, even when the piece itself is obscured. The right player knows the position of player piece 18 only after it has advanced (in the order of decreasing numbers) and has moved from position 1 to the first position within the play area — position 16. Similar remarks apply to the player on the right side of FIG. 1. His player piece is shown at position 14 and thus the number 14 appears within his shield 24.

Each of the player pieces 17 and 18 has two halves, represented by the letters R and C. The letter R represents the image of a "robber" and the letter C represents the image of a "cop." The first player to enter the play area has his player piece enter as a robber, that is, a potential loser. In the case of FIG. 1, player piece 17 was the first to enter the play area and thus image 17-R is seen. Whenever the player piece of a player enters the play area, while his opponent's piece is already there, instead of entering as a robber he enters as a cop. Thus within the play area of FIG. 1, player piece 18 is shown entering as a cop, with image 18-C being seen. As will be described below, each player piece is rotated within the mechanism so that it enters the play area with the proper image being seen. Actually, in FIG. 1 the left player has only started to move his lever 20 and his player piece has not yet fully switched to the cop image. By the time the numeral 16 appears within sheild 25, player piece 18 will have completely switched. The phantom lines 17-R and 18-R simply depict two other illustrative positions for the player pieces at earlier stages of play.

At the same time that a player piece first enters the play area while the other player piece is already there, the score of the player who "caught" the other player is incremented automatically.

Referring to FIG. 1, a hole or window **15*b* is formed in the cover. A gear 27 (FIG. 5) secured to pin 27*a* extends upwardly through another hole in the cover, and around the periphery of the upper surface of gear 27 there are the numbers 0–11. At the start of the game, pin 27*a* is rotated manually until the number 0 appears in window 15*b*. Thereafter, whenever the player on the left scores a point, his gear 27 automatically moves one position so that his score is incremented. A similar gear 26, pin 26*a* and window 15*c* are provided for the player on the right side of the game. (At the start of the game, the players look away from the game and alternately take several moves each; in this way, the game begins with each player having selected for himself a starting position for his respective player piece unaware of the position selected by his opponent. It is only after the player pieces have been thus positioned that the two counters are set to zero and that the play begins.) The gears 26 and 27 are held in place by a double-sided spring datent 43, shown most clearly in FIG. 4. Spring 43 is secured to a ridge 15*g* which extends from the side of the cover 15. The gears 26 and 27** themselves are automatically incremented in a manner which will be described below.

Lever 19 is moved in the counter-clockwise direction by the player on the right side of FIG. 1 to control movement of his player piece 17 in the counter-clockwise direction. As will be described below, at the same time that the lever is rotated, it can be pushed in slightly. A spring within the mechanism biases the lever outwardly. If the player grips pin **19*a* and rotates the lever 19 without pushing in at the same time, player piece 17 will move only one position. The move takes place during the last part of the counter-clockwise travel of lever 19. The player then returns lever 19 to its starting position. If at the same time that the player rotates the lever he pushes it in, then player piece 17 moves three positions instead of one (the additional two steps being taken during the first part of the counter-clockwise travel of lever 19). A very slight inward push is all that is required, a movement so slight that the other player cannot even tell whether a one-step or a three-step move is being taken. And because of the scraping noise which is generated as described above, there is no way to tell by any sounds generated within the mechanism. Similarly, the player on the left side of FIG. 1 grips pin 20*a* and moves lever 20 in the upward (clockwise) direction of FIG. 1 so that player piece 18 advances in the clockwise direction. Whether a one-step or a three-step move is taken depends upon whether lever 20** is pushed in against the force of its bias spring.

Figure 5:
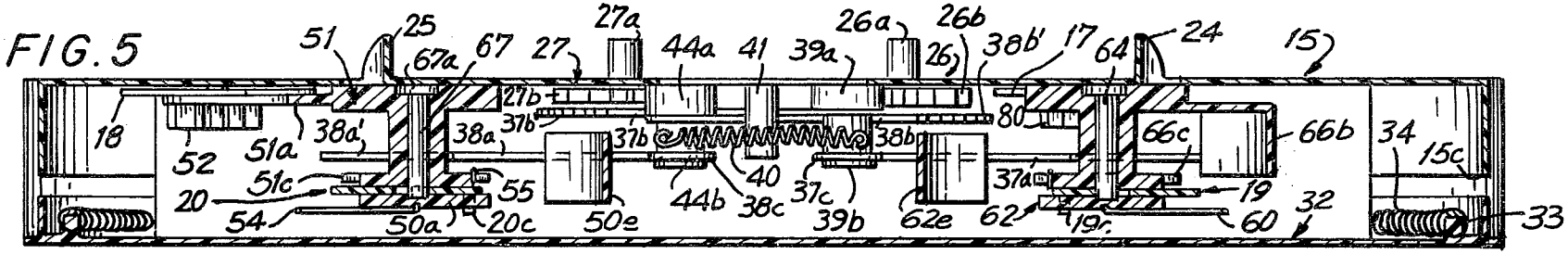
FIG. 5 is a sectional view through the line 5—5 of FIG. 4.

The basic mechanism can be most clearly understood with reference to FIGS. 4 and 5. The same elements are used to control each player piece, although because the two pieces move in opposite directions (so that they both enter the play area 16 in the same direction), the individual elements are mirror images of each other. With reference to lever 20 and player piece 18, there are three main elements. The first is element 50 which is fixed to the cover 15, and which includes several parts. The second is the lever 20 itself and the various elements associated with it. The third is the rotating element 51 at the tip of which the player piece 18 is mounted. The corresponding elements on the other side of the game are elements 62, 19 and 66.

Element 50 serves three main functions. First, the element includes a curved section **50*e* which obscures the moving part from the view of a player on the other side of the game looking through open play area 16. Second, the element includes a gear segment 50*f* which serves to rotate player piece 18, as will be described below, so that the robber image is always disposed away from the center of rotation, as shown in FIG. 4. As the element 51 rotates in the counter-clockwise direction and leaves play area 16, gear 52, which is secured by a pin passing through element 51 to player piece 18, is rotated by gear segment 50*f* such that even if the cop image of player piece 18 was depicted in the play area, the piece is rotated so that the robber image is furthermost from the center of rotation. This prepares player piece 18 to enter the play area as a robber — unless the piece of the other player enters first, in which case player piece 18 will be rotated back to depict its cop image just prior to entering the play area. (Although not shown in the drawing, stops can be provided on elements 51 and 18, and on elements 66 and 17, to limit the rotation of the player pieces between two extreme positions, but these stops are not necessary. Each player piece should be held tightly against its carrier 51 or 66 so that once it is rotated to depict either its cop image or its robber image, the player piece remains in that position until it is switched once again.) The third function of element 50 is that it, together with pin 20*c* on lever 20, controls whether element 51 and player piece 18 move one position or three positions during each forward movement of lever 20**, depending upon whether the lever is pushed in or allowed to remain biased outwardly.

The lever 20 itself is the mechanism for transmitting motion to element 51 through a ratchet and pawl arrangement which will be described below. Element 51 is the piece which rotates and carries the player piece 18 with it. The element includes ratchet teeth **51*c* which are moved by a pawl 70 attached to lever 20, and it also includes a sector cam 51*b*. It is this cam which moves element 38 as will be described below whenever player piece 18 is in the play area. The movement of element 38 causes the other player piece 17 to switch to a cop image should the player on the right side of FIG. 4 move his player piece into the play area while the piece of the player on the left side is already in the play area. Element 38 is moved from its normal position to the position which controls the switching of player piece 17 for as long as cam 51*b* bears against it, and this condition exists in turn for as long as player piece 18 is between positions 16 and 12** in the play area.

Element 38 consists of two parts as seen most clearly in FIGS. 4 and 5. The element is mounted for movement on pivot 44, pivot 44 having large section **44*a* secured to the undersurface of cover 15, a central shaft and a bottom section 44*b* which holds element 38 in place on the pivot free for rotational movement. Element 38 consists of two flat sections 38*a* and 38*b*, joined by a sleeve 38*c* which is mounted on pivot 44. Section 38*a* terminates in cam surface 38*a*′ (FIG. 4) which is the actual surface engaged by rotating sector cam 51*b*. When player piece 18 is in the play area, element 38 rotates slightly counter-clockwise in FIG. 4. The other flat section 38*b* of element 38 terminates in a gear segment 38*b*′. When element 38 is in its normal position as shown in FIG. 4, movement of element 66 in the clockwise direction results in gear 80, which is secured to player piece 17, passing by gear segment 38*b*′ without engaging it. Player piece 17 enters the play area with its robber image depicted. However, if player piece 18 is already in the play area, gear segment 38*b*′ is closer to the center of gear 80, and gear 80 and segment 38*b*′ engage each other. At this time the continued movement of element 66 in the clockwise direction results in the rapid counter-clockwise rotation of player piece 17. It is in this way that the player piece is switched so that the cop image comes into view. As player piece 17 rotates in the counter-clockwise direction, projection 17*a* engages one of the teeth 26*b* of gear 26 and causes the gear to rotate in the clockwise direction of FIG. 4. This automatically results in the incrementing of the score of the player on the right side of FIG. 4**.

As player piece 17 continues to move in the clockwise direction and leaves play area 16, gear 80 engages fixed gear element **62*f*. This gear segment causes player piece 17 to rotate back to the position of FIG. 4 with the robber image being furthermost from the center of rotation. Gear 80 is not rotated by segment 62*f* every time it passes by the segment. It is only when player piece 17 originally depicts a cop image that gear 80 engages gear segment 62*f* so that the player piece can be restored to its initial position with the robber image being set to be viewed. Gear 80 does not contain teeth all around its periphery. If the player piece depicts a robber image in the play area, that is, if it has the orientation shown in FIG. 4, then as the player piece moves past gear segment 62*f* there is no engagement of gear 80 with it due to the missing teeth on the gear. The only time that it is necessary to rotate player piece 17 after it leaves the play area is if it previously depicted a cop image, and in this case gear 80 engages gear segment 62*f***.

Similar remarks apply to cam element 37 and gear 52. The symmetry of the arrangement is apparent. Cam element 37 is mounted on pivot 39 and a spring 40 is tied between the two cam elements such that element 38 is urged to rotate in the clockwise direction and element 37 is urged to rotate in the counter-clockwise direction of FIG. 4. The two elements are stopped by post 42 so that the movements of cam surfaces **38*a*′ and 37*a*′ inwardly toward the centers of the respective rotating elements is limited. Stop 41 is provided to limit outward rotation of the two cam surfaces although this stop is not really necessary inasmuch as outward movements of cam surfaces 38*a*′ and 37*a*′ are controlled by rotating sector cams 51*b* and 66*b*** respectively.

Referring to FIGS. 4 and 5, lever 20 is shown just after the player on the left has started to move it in order to advance his player piece 18. The lever includes a long section **20*b* which at its end includes a slot 20*e* through which post 67 passes. The post is secured at 67*a* to the underside of the cover and its other end is held fixed in a hole provided for this purpose in flat section 50*a* of element 50. It is the provision of the slot 20*e* which allows lever 20 to be pushed in toward post 67** at the same time that the player on the left side grips pin 20*a* and moves lever 20. A spring 54 is secured at one end to flat section 50*a* of element 50, at a point directly beneath post 67 (see FIG. 5), and the spring is secured at its other end in a hole 20*d* in the lever. The spring normally forces lever 20 outwardly (as shown in FIG. 4). If the lever is moved while it is biased outwardly, element 51 and player piece 18 move only one position during the complete travel of lever 20. As will be described below, if the lever is pushed in at the same time that it is rotated, elements 51 and 18 move three positions.

Figure 15:
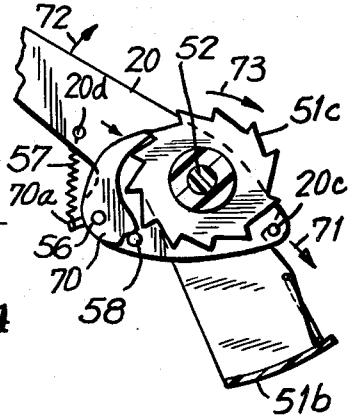
FIG. 15 shows the detail of one of the two ratchet and pawl assemblies which control advances of the player pieces.

The lever includes a projection at the tip of which there is mounted a pin 56 (see FIGS. 4 and 15). Mounted for pivotal rotation on pin 56 is a pawl 70. A pin 70*a* extends from the pawl and a spring 57 is secured between the pin and hole 20*d* on the lever. The spring rotates the pawl in the counterclockwise direction of FIG. 4 (the clockwise direction of FIG. 15), movement of the pawl being limited by stop 58 secured to the lever. This arrangement permits the pawl to be rotated in the clockwise direction of FIG. 4 (counter-clockwise direction of FIG. 15) against the force of spring 57 when the lever is being returned to its starting position at the end of a move, the tip of the pawl moving over ratchet teeth 51*c* during this process. It is during the first part of the turn of the player on the left that the tip of the pawl engages one of teech 51*c* (as shown in FIG. 15) and causes element 51 to rotate with the lever.

Whether element 51 moves one position or three positions depends on when the pawl engages one of the teeth 51*c* during forward movement of lever 20. If the lever is not pushed in, as shown by the phantom lines in FIG. 4, the tip of the pawl clears the first two ratchet teeth that it passes as lever 20 is moved. It is only the third tooth that is engaged and thus element 51 rotates only one position, toward the end of the motion of lever 20. As seen most clearly in FIG. 4, plate 50*a* which is secured to the frame includes an edge 50*b* which is relatively straight but which, at point 50*c*, curves inwardly as shown by the numeral 50*d*. Pin 20*c* is secured to the tip of lever 20 and bears against edge 50*b*. Although spring 54 tends to push the lever out of the housing, the lever movement is limited by slot 20*e* as it bears against post 67, at which time pin 20*c* bears against edge 50*b*. As lever 20 is rotated in the counter-clockwise direction of FIG. 4, pin 20*c* rides against edge 50*b*. The distance between pin 20*c* and the center of post 67 increases and as the lever continues to move it is gradually pulled in to the housing, with slot 20*e* moving relative to post 67. The distance between pin 20*c* and post 67 gradually increases as pin 20*c* travels against edge 50*b* and then edge 50*d*. Eventually, lever 20 is pulled into the housing against the force of bias spring 54 sufficiently so that the tip of pawl 70 engages the third ratchet tooth 51*c* which the tip of the pawl passes during its travel. This results in the movement of element 51 and player piece 18 only one position, as shown by the phantom lines of FIG. 4, by the end of the travel of lever 20. During the return motion, pawl 70 simply rides over the ratchet teeth 51*c* as described above.

When it is desired to move player piece 18 three positions, lever 20 is pushed in at the same time that it is rotated. With the lever pushed in even at the beginning of the player's turn, the tip of pawl 70 engages the first ratchet tooth 51*c* which it passes, as shown in FIG. 15. In this case, a move of three positions is taken.

A wire 55 is secured at one end to fixed plate 50*a* and is bent so that its other end extends in a perpendicular direction past teeth 51*c* (see FIG. 5). This wire serves to maintain element 51 in any position after it is moved by pawl 70, the wire preventing a reverse movement of element 51 due to frictional forces as lever 20 is moved back to its starting position. The wire permits only forward motion of element 51 (counter-clockwise motion in FIG. 4) as the wire rides on teeth 51*c*.

A similar mechanism is provided on the other side of the game for controlling motion of element 66 and player piece 17. Because the motion is in the opposite direction, the various pieces on the two sides of the game are mirror images of each other.

Figure 6:
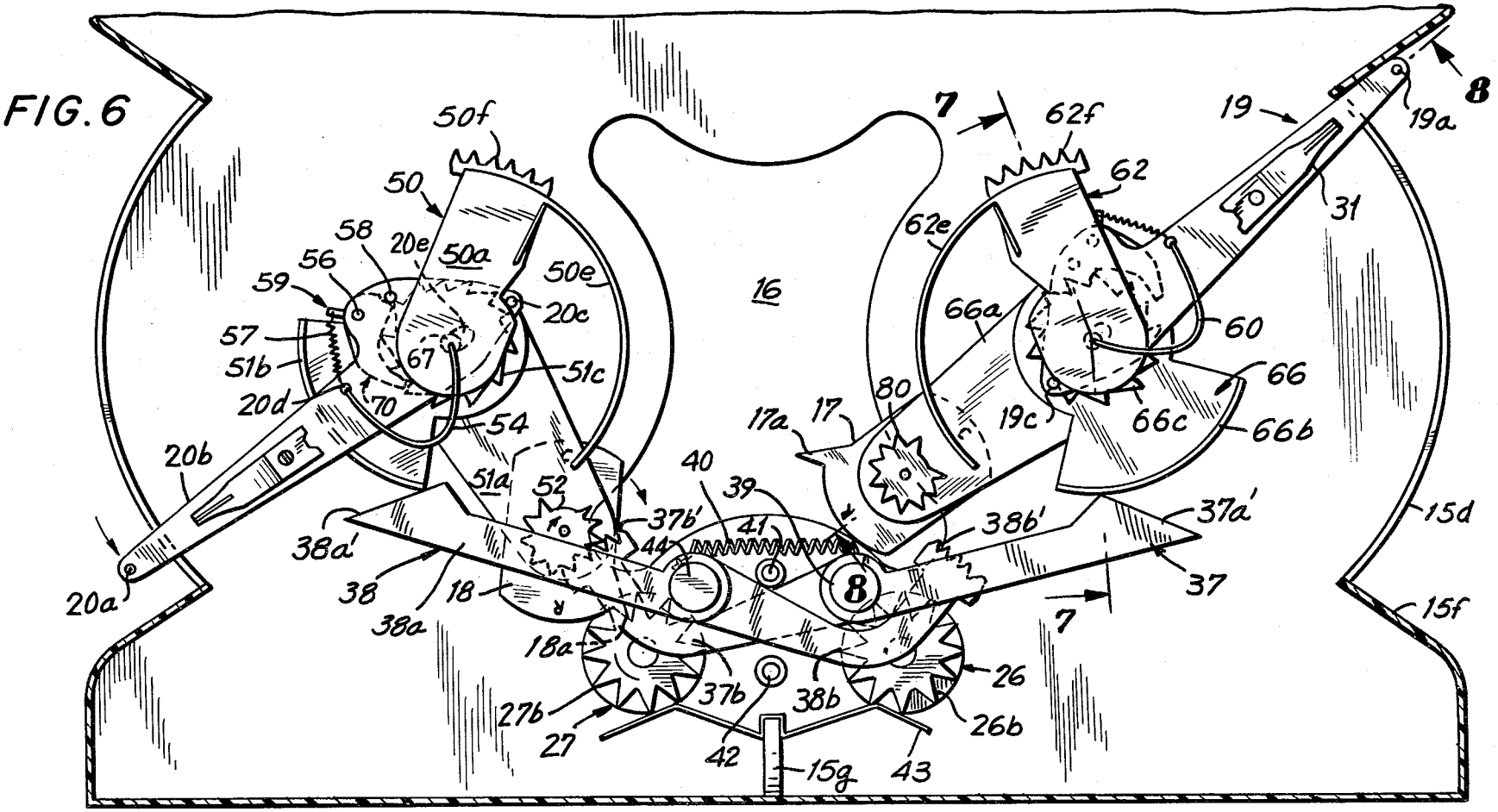
FIG. 6 is a view similar to that of FIG. 4 but shows the several elements in different positions.
Figure 8:
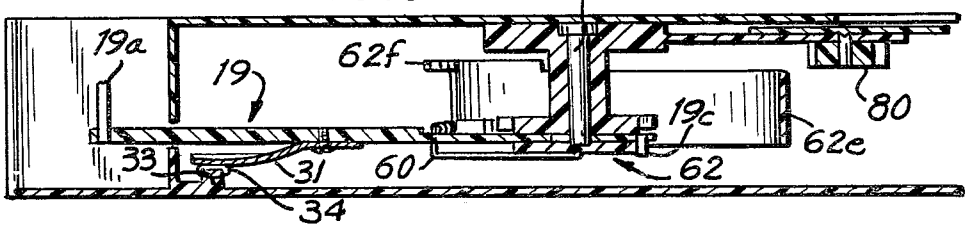
FIG. 8 is a sectional view through the line 8—8 of FIG. 6.
Figure 7:
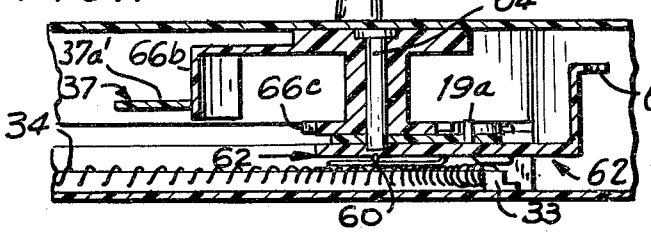
FIG. 7 is a sectional view through the line 7—7 of FIG. 6.

FIG. 6 is a view similar to FIG. 4 except that it shows the positions of the several elements toward the end of the forward travel of lever 20. (In FIG. 6, element 51 and player piece 18 are shown in a more advanced position than in FIG. 4, that is, in a position just prior to entry of the player piece 18 into the play area 16). In FIG. 6, player piece 17 is shown already in the play area and thus element 37 is rotated slightly in the clockwise direction by sector cam 66*b*. In this position, segment gear 37*b*′ is moved closer to center post 67 and thus engages the teeth on gear 52 as the gear is carried with element 51 in the counter-clockwisedirection of FIG. 6. As gear 52 moves past segment gear 37*b*′, gear 52 is rotated in the clockwise direction of FIG. 6 so that the cop image moves into the play area rather than the robber image. As player piece 18 rotates in the clockwise direction, lug 18*a* on the player piece engages one of teeth 27*b* on the scoring element 27 to thus cause the scoring element to rotate one position in the counterclockwise direction of FIG. 6. The switching of the player piece visually indicates that the player on the left has scored a point, and his score is automatically incremented by the switching of the player piece itself. It makes no difference whether the player piece enters the play area on a 1-step move or a 3-step move, or whether the player piece comes to rest at position 16, 15 or 14 (see FIG. 1). It is as the player piece first enters the play area that it is switched and the score is incremented. Once the player piece enters with its cop image being visible, this image remains visible until the player piece leaves the play area. It is only as gear 52 passes by segment gear 50*f* that the player piece is rotated in the opposite direction so that its robber image is furthermost from center post 67. The player piece is thus "reset" so that it will enter the play area as a robber if it is the first player piece to enter the play area, or so that it will score another point as it switches as it enters the play area if the player piece of the other player is already there.

Figure 9:
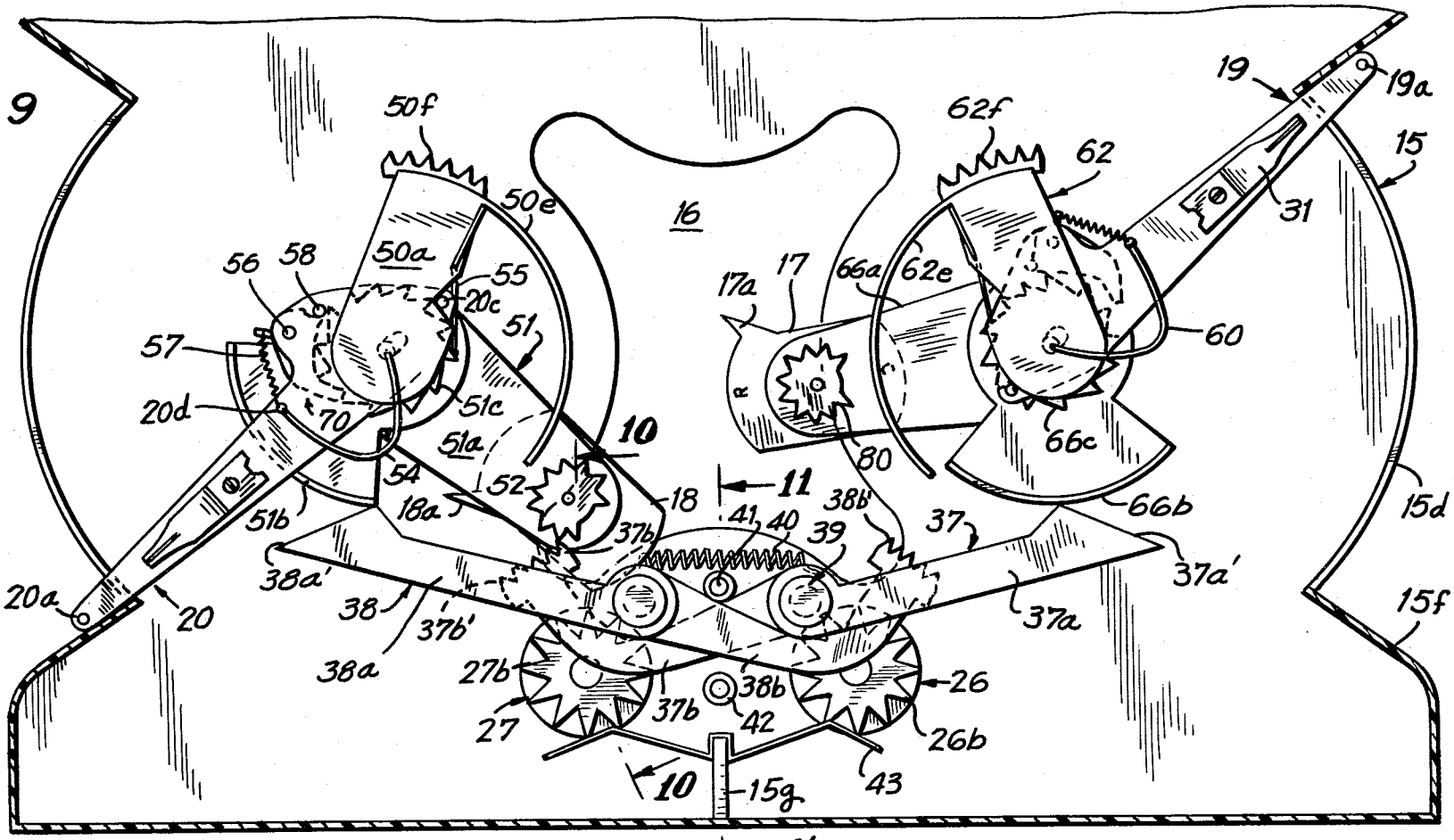
FIG. 9 is a view similar to those of FIGS. 4 and 6 but shows various elements of the game in still other positions.

FIG. 9 shows the positions of the various elements on the left side after lever 20 has been moved to its maximum limit and before it is returned. It is apparent that player piece 18 has completely switched so that its cop image is visible in the play area. It shold also be noted that as soon as player piece 18 enters the play area, sector cam 51*b* bears against lever 38 to rotate it slightly in the counterclockwise direction. This simply moves gear segment 38*a*′ inward slightly; this always happens so that player piece 17 will be switched should it enter the play area when player piece 18 is already there. Of course, in the situation shown in FIG. 9, player piece 17 entered the play area before player piece 18 and consequently it retains its robber image. (Although in FIG. 9, player piece 17 is shown in a more advanced position than it is in FIG. 6, this is only for the sake of showing other positions of the various elements on the right side of the two drawings. It will, of course, be understood that the position of player piece 17 in FIG. 6 remains unchanged while player piece 18 is being moved by the player on the left side of the game.)

Figure 12:
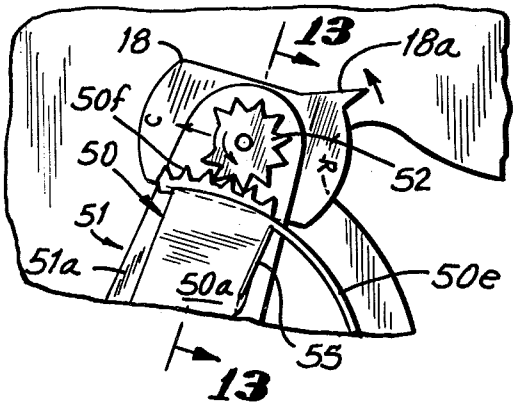
FIG. 12 is a detailed view of a portion of a player piece mechanism as its image is being changed.
Figure 13:
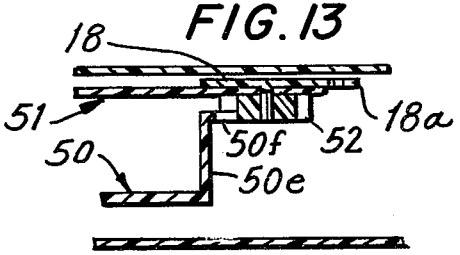
FIG. 13 is a sectional view through the line 13—13 of FIG. 12.
Figure 11:
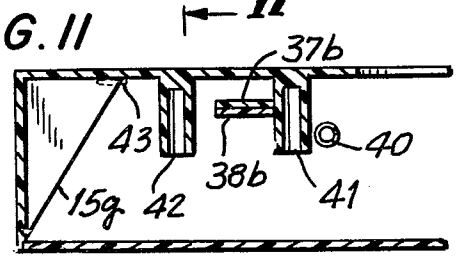
FIG. 11 is a sectional view through the line 11—11 of FIG. 9.
Figure 10:
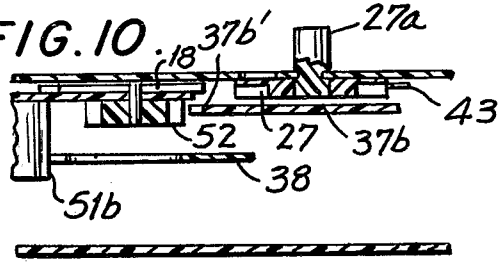
FIG. 10 is a sectional view through the line 10—10 of FIG. 9.

FIG. 12, and the sectional view of FIG. 13 taken through the line 13—13 of FIG. 12, are designed to show the manner in which player piece 18 is restored as it leaves the play area. As shown in FIG. 12, as element 51 is rotated in the counter-clockwise direction, gear 52 engages segment gear 50*f* and is rotated in the counter-clockwise direction so that the robber image of player piece 18 is disposed outwardly of element 51.

Figure 14:
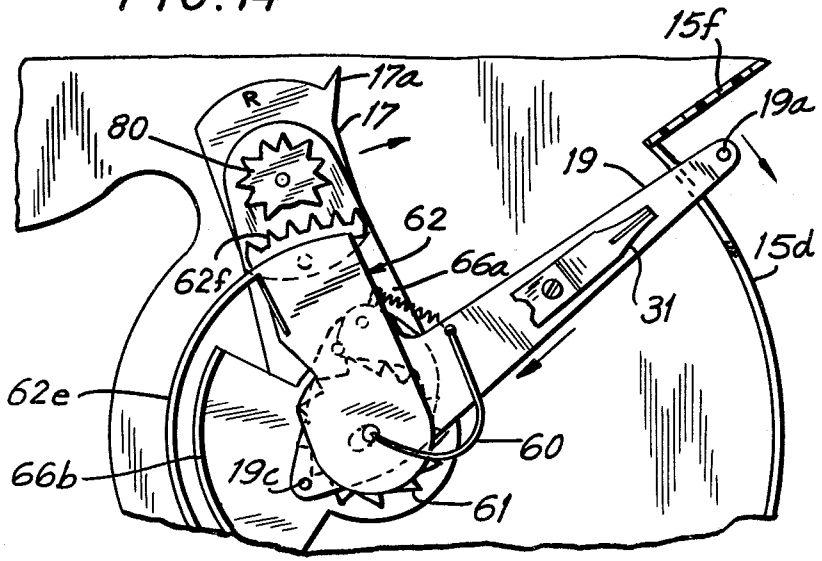
FIG. 14 is a partial view of a portion of the mechanism within the game.

FIG. 14 shows the manner in which a player piece, in this case player piece 17, remains unaffected as it leaves the play area if it was priorly in the robber position. Because some of the teeth on gear 18 are missing, the gear does not engage segment gear 52*f*, and player piece 17 remains in the position with its robber image being outermost from the center of rotation of element 66.

The play of the game has been described above as entailing nothing more than the players taking alternate turns and trying to catch each other in the play area. In actual practice, variations in the rules may be made to add further excitement to the game. It will be recalled that the position of each player's piece is not known to the other player while it is between positions 11 and 1. It is possible to allow each player to interrogate the other as to the position of his player piece while it is "hidden." In response to an interrogation by a player, the other player must announce the position of his player piece. (Toward this end the two shields 24 and 25 may be made removable so that either player can verify the position of the player piece of the other player.) In one variation, each player is allowed a maximum number of interrogations (e.g., 10) for the duration of the game. Since an interrogation often results in a score, because a player learns of the position of his opponent's piece without giving away his own, there is an advantage to saving interrogations until the end of the game. It has been found, for example, that even with a score such as 9 to 5, if the player with the lower score still has many of his interrogations left, he can often catch up and win the game. In another variation, each player may be allowed a single interrogation during each rotation of the player piece of the other player through the "hidden" area. But in such a case, if the interrogation player does not score a point by the time that the other player leaves the play area, the interrogating player loses a point. (The players can manually decrement the scoring elements for this purpose.) It is also possible to provide a rule whereby an interrogating player loses his turn so that the interrogation is a substitute for his moving his respective player piece.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What we claim is:

1. An action game for two players comprising a piece for each player; a pair of manually operated means associated with respective players for moving the respective pieces along respective paths; means for identifying a play area through which both of said pieces move, less than half of each respective path passing through said play area; a pair of means each for enabling a respective player to select a discrete number of positions through which his respective piece is moved responsive to the operation of the respective manually operated means, both of said enabling means allowing the selection of the same minimum number of positions and the same maximum number of positions, and each of said respective paths having the same number of discrete positions therealong; and means for varying the appearance of each of said pieces when it enters said play area depending upon the presence of absence of the piece of the other player in said play area.

2. An action game in accordance with claim 1 wherein each of said manually operated means is a lever rotatable around a pivot, and each of said enabling means is responsive to the radial position of the respective lever as it is rotated.

3. An action game in accordance with claim 2 further including means for representing a score for each player, and means for incrementing the score of a player when his respective piece enters said play area while the respective piece of the other player is already in said play area.

4. An action game in accordance with claim 3 wherein each of said appearance varying means includes means for exhibiting one of two different images when the piece of a player enters said play area depending upon the presence or absence of the other player in said play area.

5. An action game in accordance with claim 4 wherein each of said appearance varying means includes a switchable element having said two different images thereon, and each of said score incrementing means is operated by the switching of the respective switchable element from a first image to a second image.

6. An action game in accordance with claim 5 wherein the appearance of a piece which enters said play area in the absence of the other piece from said play area is that of a potential loser, and the appearance of a piece which enters said play area in the presence of the other piece in said play area is that of a winner.

7. An action game in accordance with claim 6 further including means for obscuring the position of each piece from the view of the other player except when such piece is in the play area.

8. An action game in accordance with claim 7 further including means for indicating to each player the position of his respective piece along its respective path at all times.

9. An action game in accordance with claim 1 further including means for representing a score for each player, and means for incrementing the score of a player when his respective piece enters said play area while the respective piece of the other player is already in said play area.

10. An action game in accordance with claim 9 wherein each of said appearance varying means includes means for exhibiting one of two different images when the piece of a player enters said play area depending upon the presence or absence of the piece of the other player in said play area.

11. An action game in accordance with claim 10 wherein each of said appearance varying means includes a switchable element having said two different images thereon, and each of said score incrementing means is operated by the switching of the respective element from a first image to a second image.

12. An action game in accordance with claim 1 wherein the appearance of a piece which enters said play area in the absence of the other piece from said play area is that of a potential loser, and the appearance of a piece which enters said play area in the presence of the other piece in said play area is that of a winner.

13. An action game in accordance with claim 1 further including means for obscuring the position of each piece from the view of the other player except when such piece is in the play area.

14. An action game in accordance with claim 13 further including means for indicating to each player the position of his respective piece along its respective path at all times.

15. An action game for two players comprising a piece for each player; a pair of manually operated means associated with respective players for moving the respective pieces along respective paths; means for identifying a play area through which both of said pieces move, less than half of each respective path passing through said play area; a pair of means each for enabling a respective player to select a discrete number of positions through which his respective piece is moved responsive to the operation of the respective manually operated means, both of said enabling means allowing the selection of the same minimum number of positions and the same maximum number of positions, and each of said respective paths having the same number of discrete positions therealong; means for representing a score for each player; and means for incrementing the score of a player when his respective piece enters said play area while the respective piece of the other player is already in said play area.

16. An action game in accordance with claim 15 further including means for obscuring the position of each piece from the view of the other player except when such piece is in the play area.

17. An action game in accordance with claim 16 further including means for indicating to each player the position of his respective piece along its respective path at all times.

* * * * *